US007387428B1

(12) United States Patent
Browne

(10) Patent No.: US 7,387,428 B1
(45) Date of Patent: Jun. 17, 2008

(54) METHOD FOR MIXING SLURRY

(76) Inventor: James O. Browne, 980 Lucerne Ct., Mundelein, IL (US) 60060

( * ) Notice: Subject to any disclaimer, the term of this patent is extended or adjusted under 35 U.S.C. 154(b) by 0 days.

(21) Appl. No.: 11/726,183

(22) Filed: Mar. 21, 2007

(51) Int. Cl.
*B01F 13/02* (2006.01)

(52) U.S. Cl. ..... 366/106; 366/107

(58) Field of Classification Search ..... 366/101, 366/106, 107, 348; 261/77, 85, 87
See application file for complete search history.

(56) References Cited

U.S. PATENT DOCUMENTS 2,345,667 A * 4/1944 Hachmuth ..... 261/21
3,081,239 A * 3/1963 Clauss et al. ..... 366/107
3,575,384 A 4/1971 Sachs
3,669,417 A 6/1972 Cornwell
3,857,552 A 12/1974 Ohlson
3,868,262 A 2/1975 Ohlson
3,953,003 A 4/1976 Mahig
4,046,358 A 9/1977 Grimes
4,221,603 A 9/1980 Trujillo
4,298,287 A 11/1981 McCarter, III et al.
4,383,864 A 5/1983 Trujillo
4,787,938 A 11/1988 Hawkins
4,895,451 A 1/1990 Hockett
4,941,599 A 7/1990 Reinertz et al.
4,946,283 A 8/1990 Musil
5,002,398 A 3/1991 Musil
5,002,426 A 3/1991 Brown et al.
5,009,508 A 4/1991 Wojdylo
5,090,813 A 2/1992 McFarland et al.
5,174,650 A 12/1992 McFarland et al.
5,226,960 A 7/1993 Punkert
5,342,124 A 8/1994 Swisher, Jr.
5,352,275 A 10/1994 Nath et al.
5,380,082 A 1/1995 Milstead
5,380,084 A 1/1995 Milstead
5,470,146 A 11/1995 Hawkins
5,512,093 A 4/1996 Huege et al.
5,570,953 A 11/1996 DeWall
5,586,731 A 12/1996 Glaze et al.
5,620,249 A 4/1997 Musil
5,664,882 A 9/1997 Green et al.
5,676,716 A 10/1997 Gohara et al.
5,824,141 A 10/1998 Gohara et al.
5,914,034 A * 6/1999 Ding et al. ..... 210/221.2
6,000,876 A 12/1999 Shen et al.

(Continued)

*Primary Examiner*—David Sorkin
(74) *Attorney, Agent, or Firm*—Meroni & Meroni, P.C.; Charles F. Meroni, Jr.; Christopher J. Scott

(57) ABSTRACT

A slurry mixer comprises a container assembly and pressurized air delivery system for mixing gravitationally separable heavy particulate of target slurry. The container assembly essentially comprises an inferior container portion, a superior container portion, a vertical container diameter, and accumulator plates, which plates are spatially located in superior adjacency to the inferior container portion orthogonal to the vertical container diameter. The air delivery system delivers compressed air to a gas outlet cooperable with the accumulator plates for outletting gas into the container assembly. The accumulator plate feature functions to plate-shape the outlet gas into a substantially planar initial bubble shape. The initially planar bubble shape is upwardly directed toward the superior tank portion in radial adjacency to the vertical container diameter. The outlet gas displaces slurry components via dynamic matter-displacing bubble action, and the initially planar bubble shape maximizes the matter-displacing effectiveness of the bubble action for mixing the slurry.

12 Claims, 13 Drawing Sheets

U.S. PATENT DOCUMENTS 6,045,608 A 4/2000 Mitchell et al.
6,139,612 A 10/2000 Kitigawa et al.
6,363,625 B1 4/2002 Niemi
6,375,386 B1 4/2002 Macku et al.
6,656,242 B1 12/2003 Golightly et al.
6,799,683 B2 * 10/2004 Jounela et al. ..... 209/169
RE39,289 E 9/2006 Mitchell et al.

* cited by examiner

METHOD FOR MIXING SLURRY

BACKGROUND OF THE INVENTION

1. Field of the Invention

The disclosed invention generally relates to an apparatus for mixing slurries such as coal tar and asphalt based sealers. More particularly, the disclosed invention relates to an apparatus and associated method for mixing slurries by way of air-pulse agitation.

2. Brief Description of the Prior Art

Conventional methods and systems for mixing slurries such as coal tar and asphalt based sealers have incorporated mechanical mixing implements such as paddles. Less conventional methods include air or bubble-action agitation of the slurry mixture. While paddle-type slurry mixers may well function to properly mix a slurry into a uniform mixture, the machinery is often costly, complicated, and requires a great deal of maintenance. Air-based slurry mixing systems fare no better than their paddle mixing counterparts in terms of cost, complexity and inherent need for high levels of maintenance and care. Those systems that have been simplified in design so as to overcome the cost and complexity-related difficulties attendant to such designs often prove ineffectual for properly mixing the slurries. Some of the more pertinent art relating to paddle-type mixers, air-type mixers and the like is briefly set forth hereinafter.

U.S. Pat. No. 3,953,003 ('003 patent), which issued to Mahig, discloses a Tank Provided with Pneumatic Mixing Pipe. The '003 patent teaches a container adapted to thoroughly mix fluid material, especially suspensions, comprising a tank provided with a vertical mixing pipe, a vertical air lifting pipe, a gas collecting chamber located at the upper end of the mixing pipe, and a connecting pipe affixed at one end to the collecting chamber and communicating therewith and affixed at its other end to the bottom of the air lifting pipe and communicating therewith.

U.S. Pat. No. 4,298,287 ('287 patent), which issued to McCarter, III et al., discloses a Center Draft Asphaltic Concrete Drum Mixer. The '287 patent teaches a continuous drum mix asphalt plant wherein dust is exhausted from an intermediate zone of the drum mixer between its drying and mixing zones. The dust is exhausted radially through openings into a collection housing, which communicates with a dust collector and exhaust blower. An end housing at the discharge end of the drum communicates with the same dust collector and blower. Dampers are provided to control the relative proportion of air exhausted from the drum through the respective housings. Aggregate deflectors on the interior wall of the drum at the intermediate zone allow air and dust to flow while inhibiting the flow of aggregate. The collection housing surrounding the intermediate zone is of a size such as to produce a reduction in the velocity of the air as it passes out of the drum. Consequently, it serves as a knock-out box for the collection of larger particles which are carried out of the drum, but which settle out of the air stream as a result of the velocity decrease. These collected particles are reintroduced into the drum by scoops on the exterior of the drum. These scoops are also used for the introduction of recycled asphaltic concrete.

U.S. Pat. No. 4,895,451 ('451 patent), which issued to Hockett, discloses a Mixing Device. The '451 patent teaches an improved mixing device for mixing an abrasive such as sand with a flowing fluid such as compressed air. The improved mixing device comprises a body member having a major internal channel being defined along a major axis.

The major internal channel extends between a major input and a major output of the major internal channel. The body member includes a minor internal channel defined along a minor axis and extending from a minor input to an intersection with a portion of the major internal channel located between the major input and the major output of the major internal channel. The flowing fluid is directed into the major input whereas the abrasive is directed into the minor input for enabling the abrasive to mix with the flowing fluid within the major internal channel and to discharge from the major output. The minor internal channel is established at an acute angle relative to the major internal channel and extends generally toward the major input of the major internal channel for enabling abrasive erosion of the body member to be distributed over a region of the body member during prolonged use of the mixing device.

U.S. Pat. No. 4,941,599 ('599 patent), which issued to Reinertz et al., discloses a Method and Apparatus for Thoroughly Mixing a Suspension Containing a Fluid and Solid Matter Constituents. The '599 patent teaches an apparatus and a method for thoroughly mixing a suspension containing a fluid and solid matter constituents and spraying the thoroughly mixed suspension onto a surface. The apparatus includes a pressure and seal tight container enclosed on all sides for accommodating the suspension therein. The container has a top region and has a base region whereat the solid matter constituents tend to collect to form a sediment. A cylinder and a piston generate a charge of air under pressure which is conducted through a passage into the base region of the container to break up the sediment and thoroughly mix the solid matter constituents in the fluid as the air under pressure rises through the suspension to collect at the top region of the container where it imparts pressure to the suspension. A nozzle unit mounted on the container vents the container to permit the air under pressure to entrain the thoroughly mixed suspension to form a spray. With the invention, the suspension is always thoroughly mixed for each pumping operation and during the spraying operation so that a loss of function because of blockage of the spray system is prevented.

U.S. Pat. No. 5,002,426 ('426 patent), which issued to Brown et al., discloses a Paddle Mixer for Asphalt Pavers. The '426 patent teaches a revolving paddle mixer for re-mixing a hot asphalt mix deposited in the hopper of a road paving machine. The mixer takes the form of a plurality of paddles angularly positioned relative to each other and mounted on a revolving shaft adjacent to the conveyor for transporting the asphalt mix material to the rotating auger. The resultant re-mixture is more uniform and dense so that a smooth pavement is laid on the roadway.

U.S. Pat. No. 5,009,508 ('508 patent), which issued to Wojdylo, discloses an Apparatus for Mixing Concrete. The '508 patent teaches an abstract for mixing concrete which includes a tank having at least a portion thereof which permits the inside of the tank to be visually observed from the outside of the tank. An inlet is disposed in the top of the tank for inserting concrete ingredients. An outlet is disposed in the bottom of the tank for permitting the mixed concrete to be withdrawn from a chamber inside the tank. The tank includes seals for selectively sealing all openings into the chamber of the tank and an opening is provided for introducing air under pressure into a lower portion of the tank for the purpose of being able to mix the concrete using such air pressure.

U.S. Pat. No. 5,380,082 ('082 patent), which issued to Milstead, discloses an Asphalt Drum Mixer with Curved Scoop-like Mixing Tips. The '082 patent teaches an asphalt drum mixer comprising a rotating drum within a fixed sleeve which defines an annular chamber, and mixing tips mounted on the drum and in the annular chamber. The mixing tips pass through the hot mix asphalt lying in the bottom of the annular chamber and mix and shear the hot mix asphalt and increase its residence time in the drum mixer. In one preferred embodiment, the mixing tips may comprise curved scoop-like elements which lift the hot mix asphalt higher than conventional paddles and greatly increase residence time of the mix in the drum over conventional paddles. The quality of the mix is thus greatly improved. In another preferred embodiment the mixing tips may comprise curved scoop-like elements having slots which greatly increase sheering of the hot mix asphalt, thereby further improving the quality of the mix.

U.S. Pat. No. 5,586,731 ('731 patent), which issued to Glaze et al., discloses a Compost Mixing and Aerating Apparatus. The '731 patent teaches an improved composting apparatus particularly suited for use with straw-like materials. The composting apparatus includes a counter-rotating drum and paddle assembly which generates a plurality of air streams in which the composting material is entrained. The air streams rotate in a vortex like pattern within a chamber to mix and aerate the composting material. The composting apparatus is configurable for being driven sideways through fence gates and the like, and has an additional configuration for being towed without requiring a trailer.

U.S. Pat. No. 5,676,716 ('716 patent), which issued to Gohara et al., discloses an Apparatus for Mixing a Tank and Improving Air/Liquid Contact in an Oxidized System. The '716 patent teaches an apparatus to mix a slurry mixture with an oxidization air within a reaction tank of a wet scrubber spray tower of a flue gas desulfurization system for a furnace. The apparatus improves the contact between forced oxidization air and slurry mixture within the reaction tank. U.S. Pat. No. 5,824,141 ('141 patent), which also issued to Gohara et al., discloses an apparatus to mix a slurry mixture with an oxidization air within a reaction tank of a wet scrubber spray tower of a flue gas desulfurization system for a furnace. The apparatus improves the contact between forced oxidization air and slurry mixture within the reaction tank.

From a consideration of the foregoing disclosures, it may be seen that the prior art discloses complex paddle-type mixers (e.g. the '426 and '082 patents); complex air-type mixers (e.g. the '003, '451, and '599 patents), and simplistic air-type slurry mixers (e.g. the '508 patent). Coal tar sealers, asphalt based sealers, and similar other slurry type mixtures (such as concrete) having heavy (or gravitationally separable) particulate mixed with aggregate are generally easier to blend with air agitation than by conventional paddle agitation. The prior art thus perceives a need for a simplified air-based slurry mixing apparatus and/or methodology, which apparatus and associated method may well function to provide a homogenous slurry mixture at minimized cost and maintenance.

SUMMARY OF THE INVENTION

It is an object of the present invention to provide a slurry mixing apparatus that creates a more homogenized mixture of materials with less effort and maintenance. To achieve this and other readily apparent objectives, the present invention essentially discloses air accumulators evenly spaced at the bottom of tank, which air accumulators function to keep aggregate in suspension through the tank and create a more even distribution of aggregate, without buildup at the bottom of the tank. Whereas the conventional sweeping paddle design has a space between the paddles and the tank, which leaves a buildup of sealer at the bottom and sides of the tank, the air pulse agitation of the present invention pulses air along the bottom and sides of the tank with uniquely configured initial bubbles formed by way of the accumulator plates. The apparatus and method of the present invention thus functions to agitate all material for a uniform slurry mixture and cleaner tank without sealer buildup. Further, by design, the so-called Pulse Agitation System of the present invention eliminates many of the moving parts that break down over time. Eliminating complex structural systems and parts such as hydraulic systems, motors, gears, chains, seals, paddles, and leaky bearings enhances the operability of the underlying apparatus and makes downtime as resultant from equipment failure a thing of the past.

Stated another way, the slurry mixing system of the present invention is designed to mixing slurry components, and is contemplated to essentially comprise a container assembly and certain gas delivery means for use in combination with a slurry. The target slurry of the present invention necessarily comprises a liquid medium, a light particulate, and a heavy particulate. The light particulate is suspendable in the liquid medium and the heavy particulate falls out of the liquid medium or is gravitationally separable from the liquid medium.

It is further contemplated that the container assembly essentially comprises an inferior container portion, a superior container portion, a vertical container diameter, and at least one, but preferably plural, accumulator plates, which plates are spatially located in superior adjacency to the inferior container portion orthogonal to the vertical container diameter. The gravitationally separable heavy particulate is accumulative adjacent the accumulator plate(s).

The gas delivery means of the present invention essentially comprise a gas source such as an air compressor, certain conduit for directing the gas source (preferably pressurized), and a gas outlet cooperable with the accumulator plate for outletting gas into the container assembly. In this last regard, and central to the practice of the present invention, it should be noted that the accumulator plate functions to plate-shape the outlet gas into an initially substantially planar bubble shape. The initially planar bubble shape is upwardly directed toward the superior tank portion in radial adjacency to the vertical container diameter. The outlet gas displaces the slurry via dynamic matter-displacing bubble action, the initially planar bubble shape for maximizing the matter-displacing effectiveness of the bubble action for mixing the slurry.

Other objects of the present invention, as well as particular features, elements, and advantages thereof, will be elucidated or become apparent from, the following description and the accompanying drawing figures.

BRIEF DESCRIPTION OF THE DRAWINGS

Other features of my invention will become more evident from a consideration of the following brief description of patent drawings.

DETAILED DESCRIPTION OF THE PREFERRED EMBODIMENT

Figure 1:
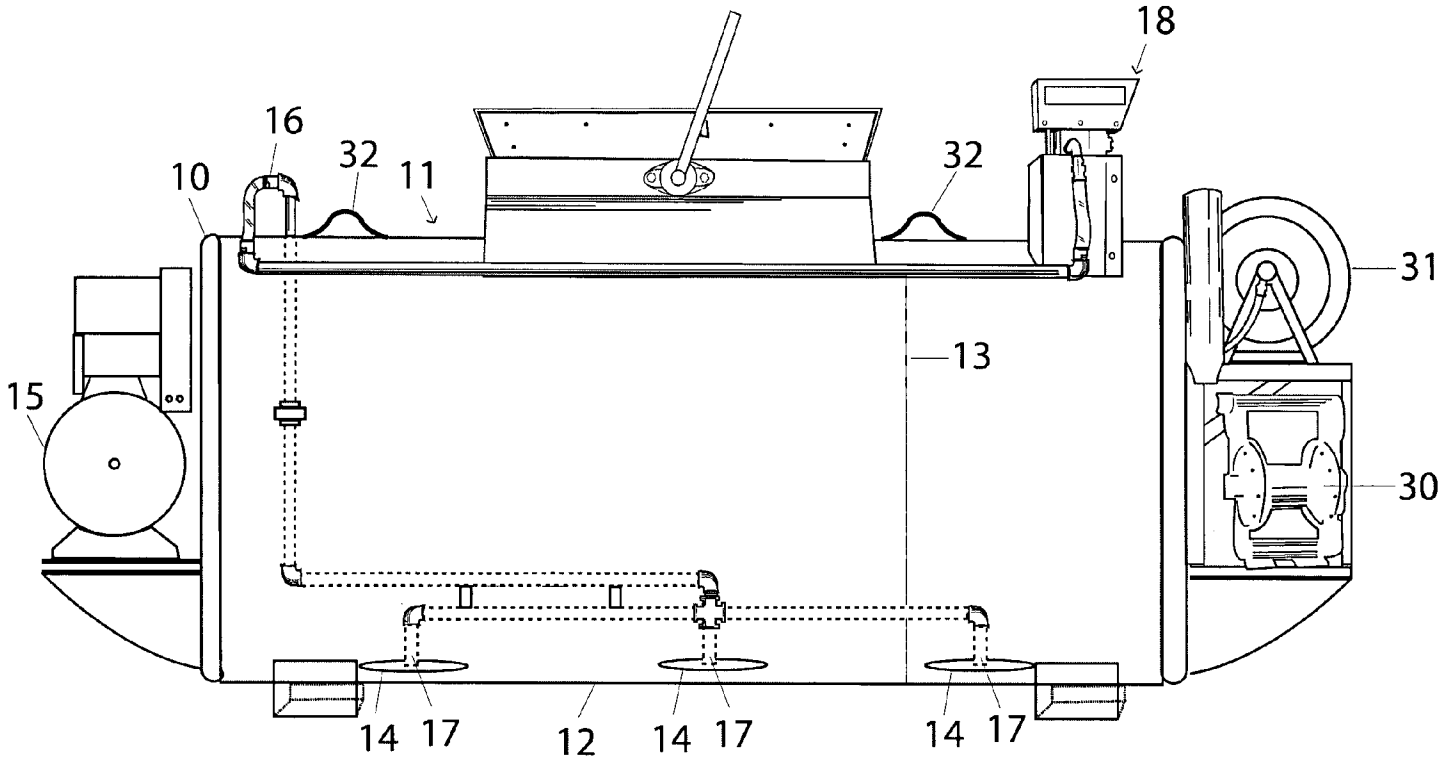
FIG. 1 is a fragmentary first side plan view of the slurry containment/mixing assembly of the present invention showing certain internal air delivery conduit and bubble-shaping implements in broken lines.

Referring now to the drawings, the preferred embodiment of the present invention generally concerns an apparatus and/or method for mixing coal tar and/or asphalt sealing slurries. Slurries, by definition comprise some liquid medium in which is dispersed certain insoluble particulate. It is contemplated that the present invention is designed for use on combination with slurries having both light (colloidal type) particulate as generally depicted and referenced at 100 and heavy particulate as generally depicted and referenced at 101 in FIGS. 6-9. In other words, coal tar and asphalt based sealers comprise certain particulate that may remain suspended in the liquid medium roughly characterized as light particulate 100 and other aggregate type particulate that falls out of solution under the action of gravitational force. The apparatus of the present invention is designed to impart forces (via bubble action) to the heavy particulate 101 that is otherwise gravitationally separable from the slurry (as generally depicted in FIG. 6) so as to provide a more uniform slurry mixture (as generally depicted in FIG. 7) for eventual output into or onto an application as necessary.

Figure 2:
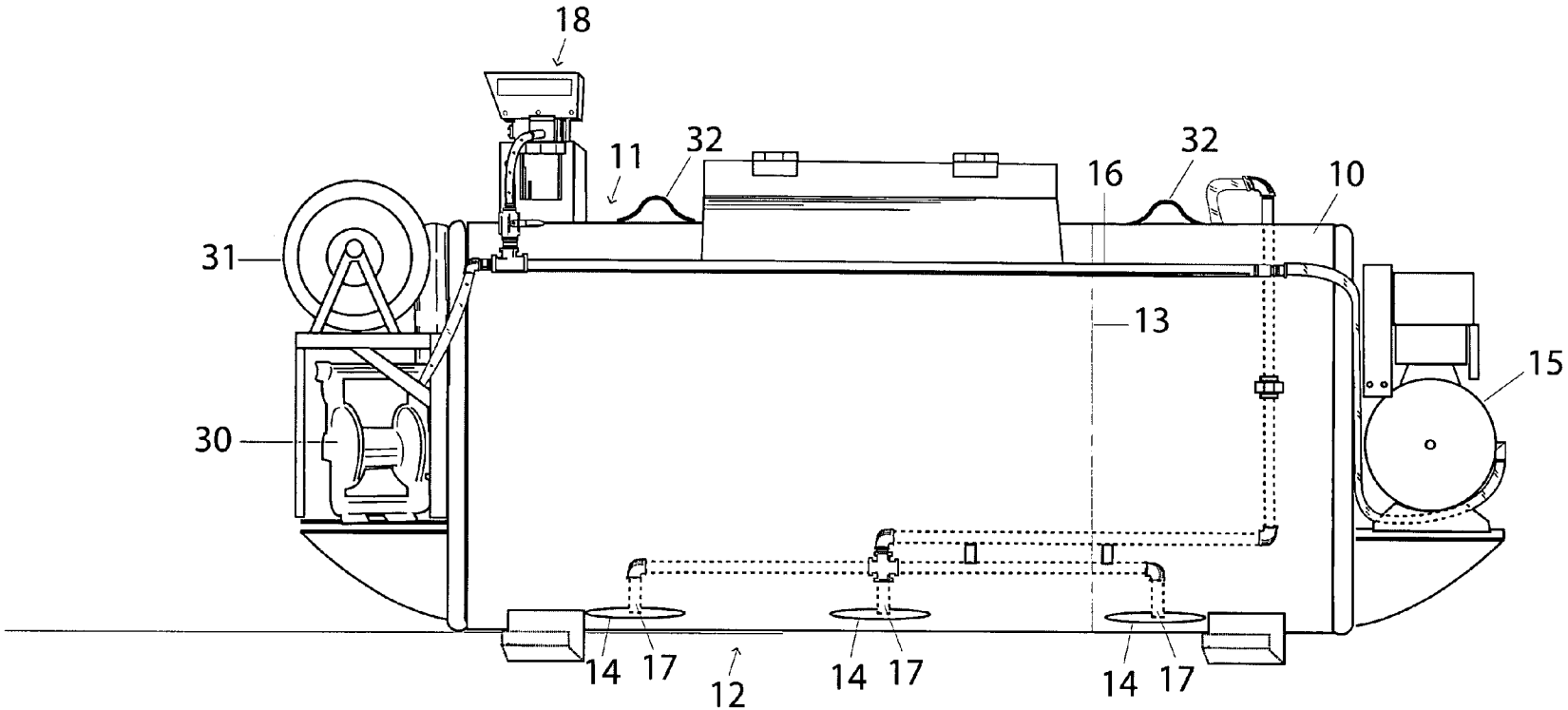
FIG. 2 is a fragmentary second side plan view of the slurry containment/mixing assembly of the present invention showing certain internal air delivery conduit and bubble-shaping implements in broken lines.
Figure 3:
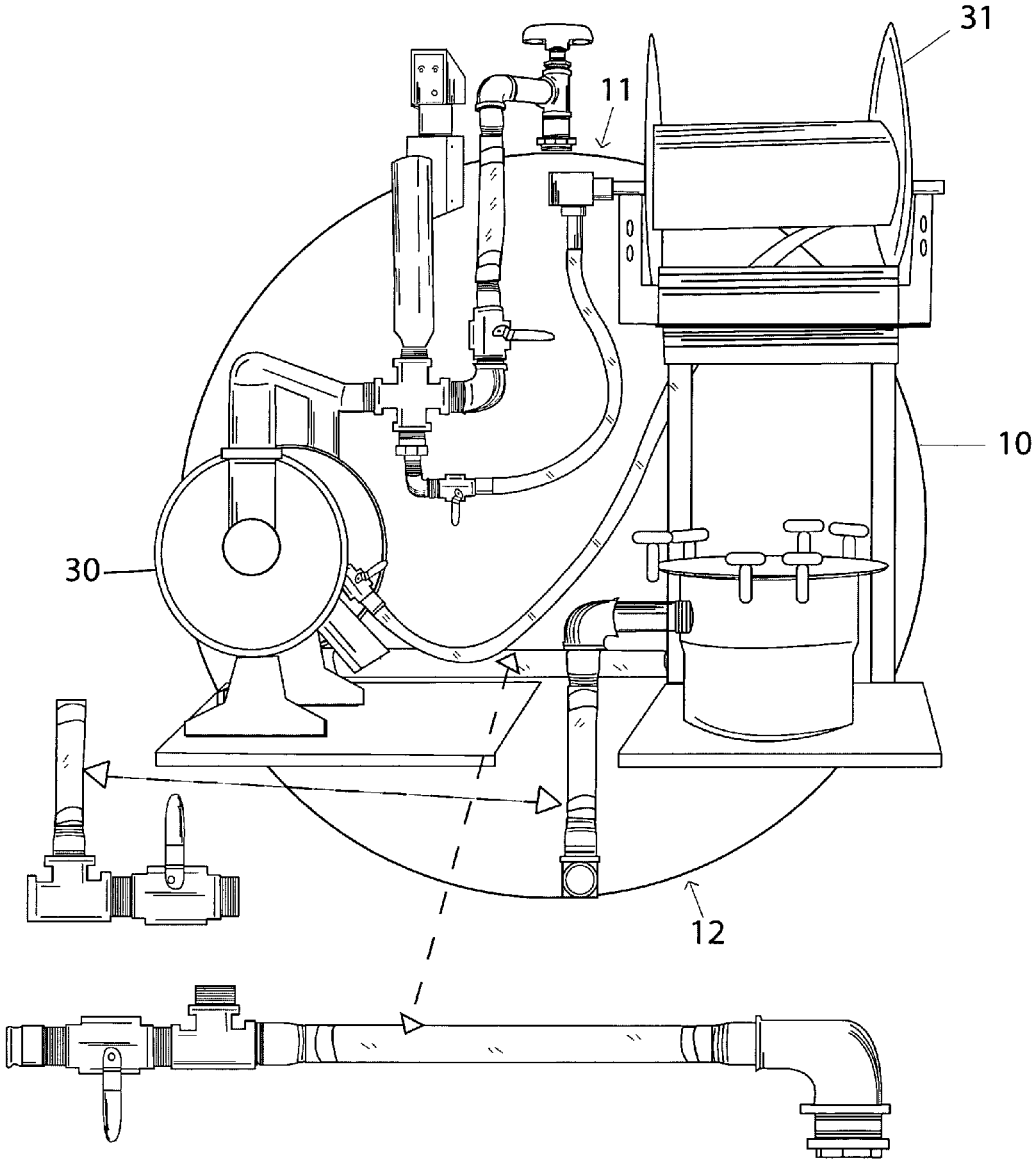
FIG. 3 is an end view depiction of the slurry containment/mixing assembly of the present invention showing certain peripheral conduit assemblies with certain of the conduit broken away from the peripheral conduit assemblies to show more detailed structure.

As with most mixing operations, the present invention contemplates the use of a slurry containment vessel or tank assembly 10 for basing or housing the mixing action. The tank assembly 10 of the present invention is generally illustrated and referenced in FIGS. 1-3, and 5-9. The tank assembly 10 of the present invention necessarily comprises a vertical dimension and thus may be said to define a vertically dimensioned structure. In this regard, it may be generally seen or understood that the tank assembly 10 inherently comprises a superior tank portion 11 as illustrated and referenced in FIGS. 1-3, and 5-9; an inferior tank portion 12 as illustrated and referenced in FIGS. 1-3, and 5-7; and a vertical tank diameter 13 extending between the superior and inferior tank portions 11 and 12 as generally depicted and referenced in FIGS. 1, 2, and 5. The tank assembly 10 or slurry container of the present invention is preferably cylindrical in form and thus preferably comprises a vertically circular transverse cross-section or profile as generally depicted in FIGS. 3, 5, 6, and 7; and a longitudinal cylinder axis as generally depicted in FIGS. 1 and 2. It is contemplated that the circular transverse cross section of the tank or container assembly 10 functions to provide smooth matter-displacement pathways for eliminating flow path pockets and debris accumulation. Thus, it is further contemplated that the circular transverse cross section ultimately functions to enhance uniformity of the slurry via the smooth matter-displacement (return) pathways.

Figure 6:
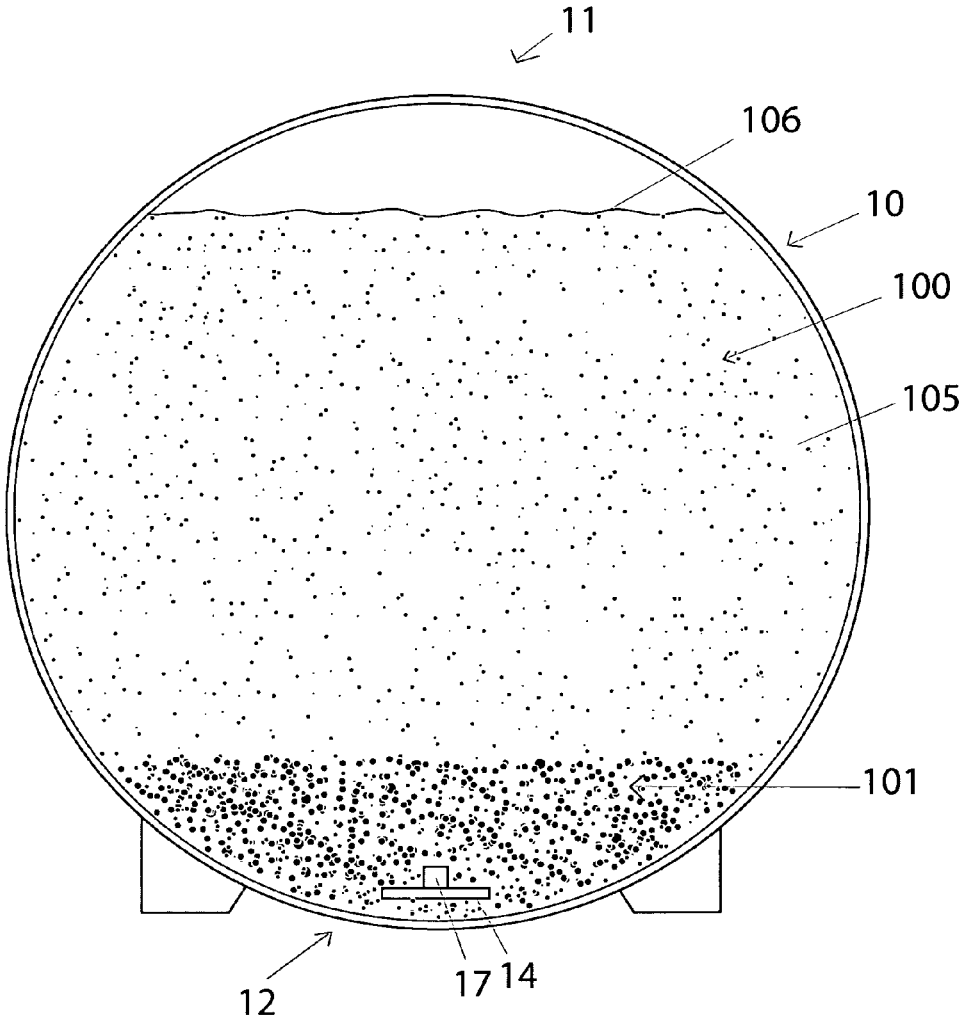
FIG. 6 is a second axial/internal diagrammatic depiction of the slurry containment/mixing assembly depicting lighter, liquid-suspended particulate and heavier, gravitationally separated particulate of a slurry contained by the slurry containment/mixing assembly of the present invention.
Figure 7:
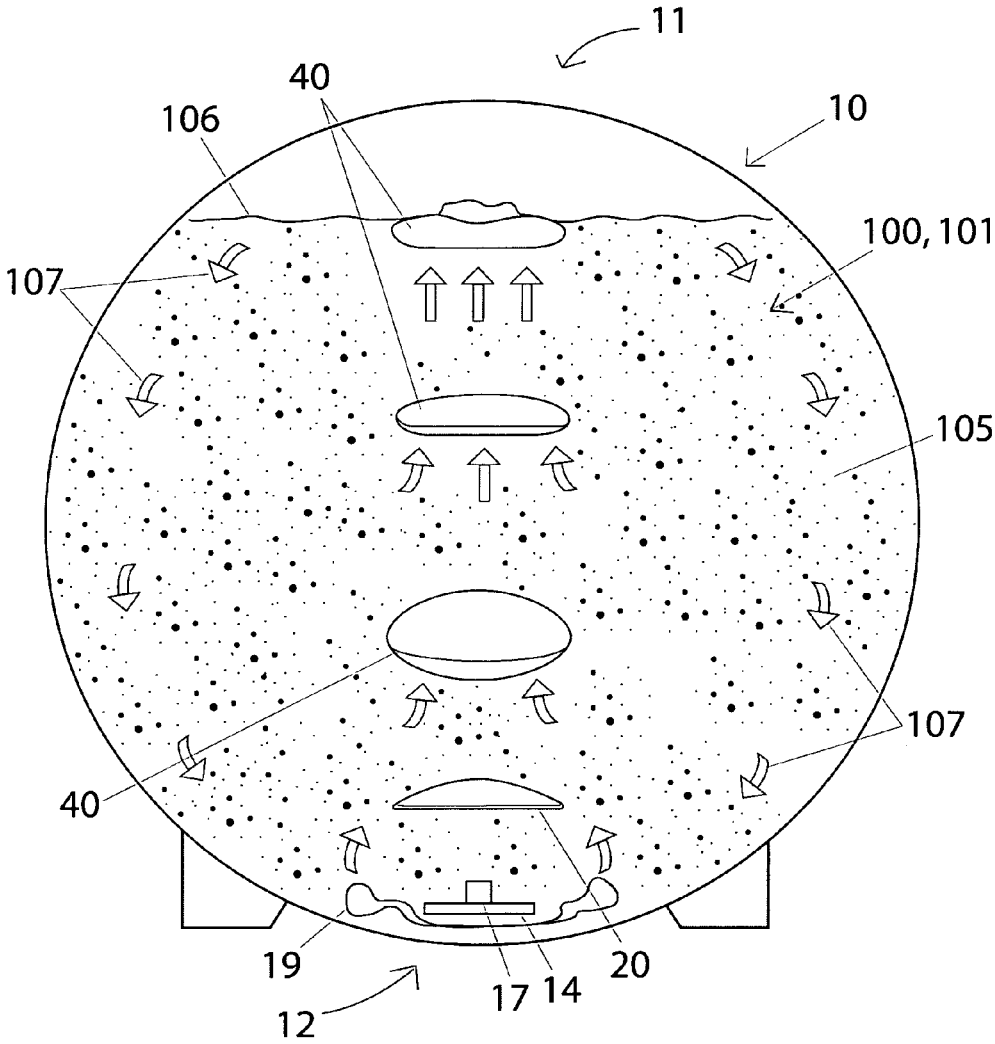
FIG. 7 is a third axial/internal diagrammatic depiction of the slurry containment/mixing assembly depicting an accumulator plate and certain flow patterns through the slurry containment/mixing assembly of the present invention for maintaining a substantially uniform particulate mixture.
Figure 8:
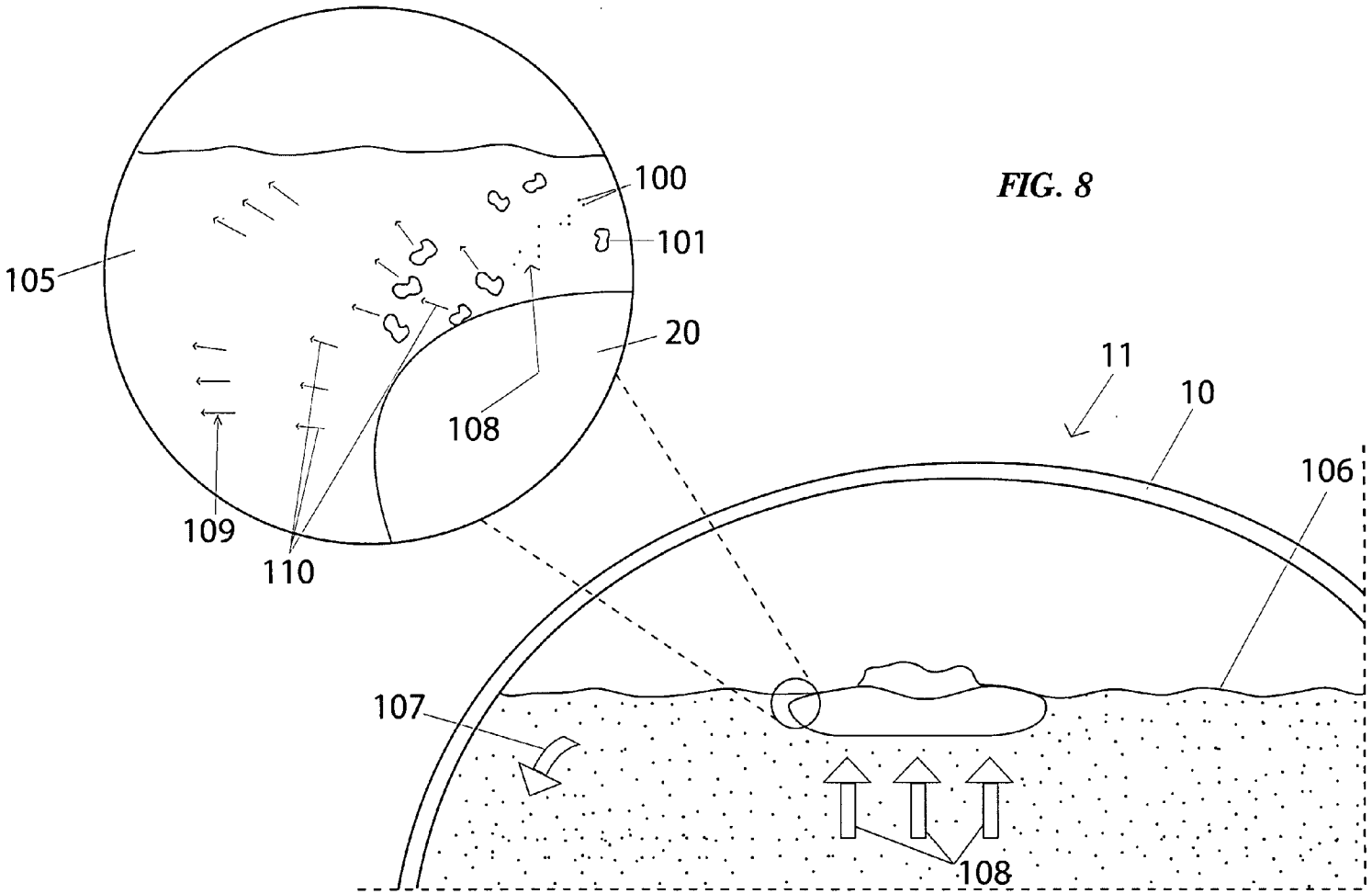
FIG. 8 is a fragmentary enlarged depiction of the upper left portions of the slurry containment/mixing assembly otherwise depicted in FIG. 7 with a further enlarged sectional diagrammatic depiction of a bubble forcing matter away from the bubble path.

The tank assembly 10 further comprises, or is otherwise cooperable with at least one, but preferably a plurality of, longitudinally spaced accumulator plates 14 as further illustrated and referenced in FIGS. 1, 2, and 5-7. The accumulator plate(s) 14 are preferably spatially oriented within the cylindrical tank assembly 10 in superior adjacency to the inferior tank portion 12. The preferred accumulator plate 14 of the present invention is substantially planar, circular, and orthogonally oriented relative to the vertical tank diameter 13 as may be understood from a consideration of the noted figures. As may be understood from the foregoing descriptions, the gravitationally separable heavy particulate 101 is accumulative adjacent the accumulator plate(s) 14 resulting in a relatively non-uniform slurry mixture as generally depicted in FIG. 6. The apparatus and method of the present invention is designed so as to effect or enhance a more uniform slurry mixture as generally depicted in FIG. 7 and as described in more detail hereinafter.

Figure 4:
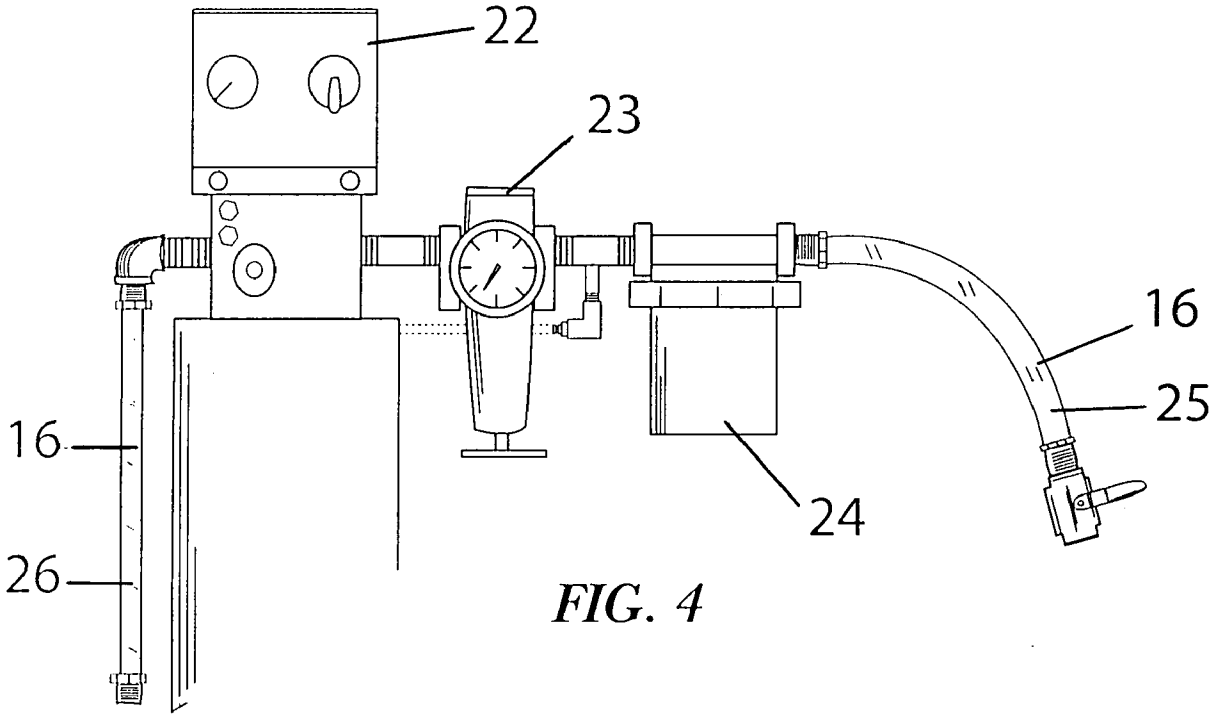
FIG. 4 is a fragmentary depiction of an air pulse regulator assembly of the present invention.
Figure 5:
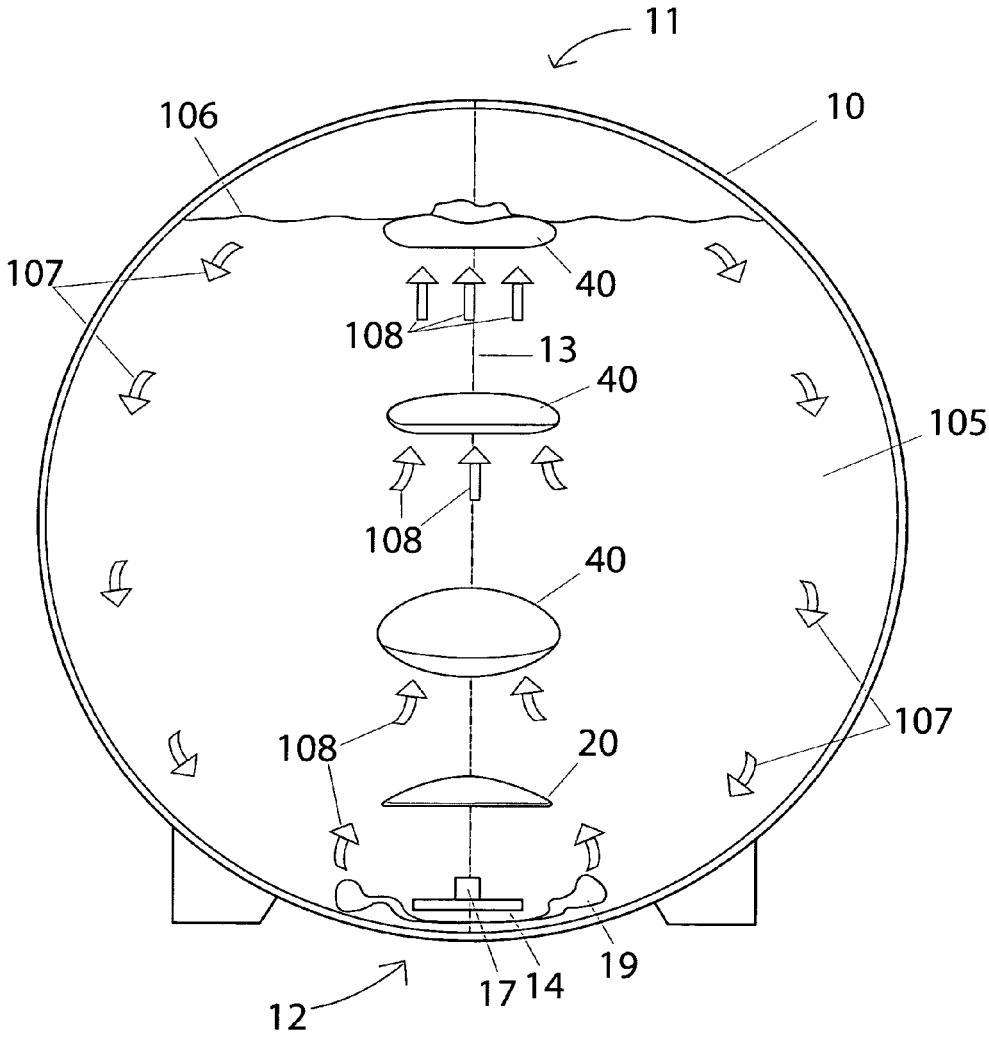
FIG. 5 is a first axial/internal diagrammatic depiction of the slurry containment/mixing assembly depicting an accumulator plate and certain flow patterns through the slurry containment/mixing assembly of the present invention.

As introduced hereinabove, the targeted slurry mixture usable in combination with the present invention is preferably mixed by way of periodic, pulsed, and/or continual bubble action, and thus the present invention further contemplates the incorporation of certain gas or gaseous medium delivery means. It is contemplated that in the preferred practice air may define the gaseous medium of the present invention and thus the gas delivery means may be further defined by a (compressed) gas source such as an air compressor 15 as illustrated and referenced in FIGS. 1 and 2; certain gas conduit 16 for delivering or directing the compressed gas to the slurry mixture as illustrated and referenced in FIGS. 1, 2, and 4; and a gas outlet or outlets 17 as depicted and referenced in FIGS. 1, 2, 5, and 7. The gas deliver means of the present invention may further preferably comprise means for regulating air release into the slurry mixture, which means may be defined by a so-called pulse regulator assembly 18 as illustrated and referenced in FIGS. 1, 2, and 4. It is contemplated that the pulse regulator may well function to deliver or direct periodic and/or continuous bursts of compressed air into the slurry mixture by way of the conduit 16 and the gas outlet(s) 17 in inferior adjacency to the accumulator plate(s) 14 as generally depicted enlarged detail in FIGS. 10 and 11.

Figure 10:
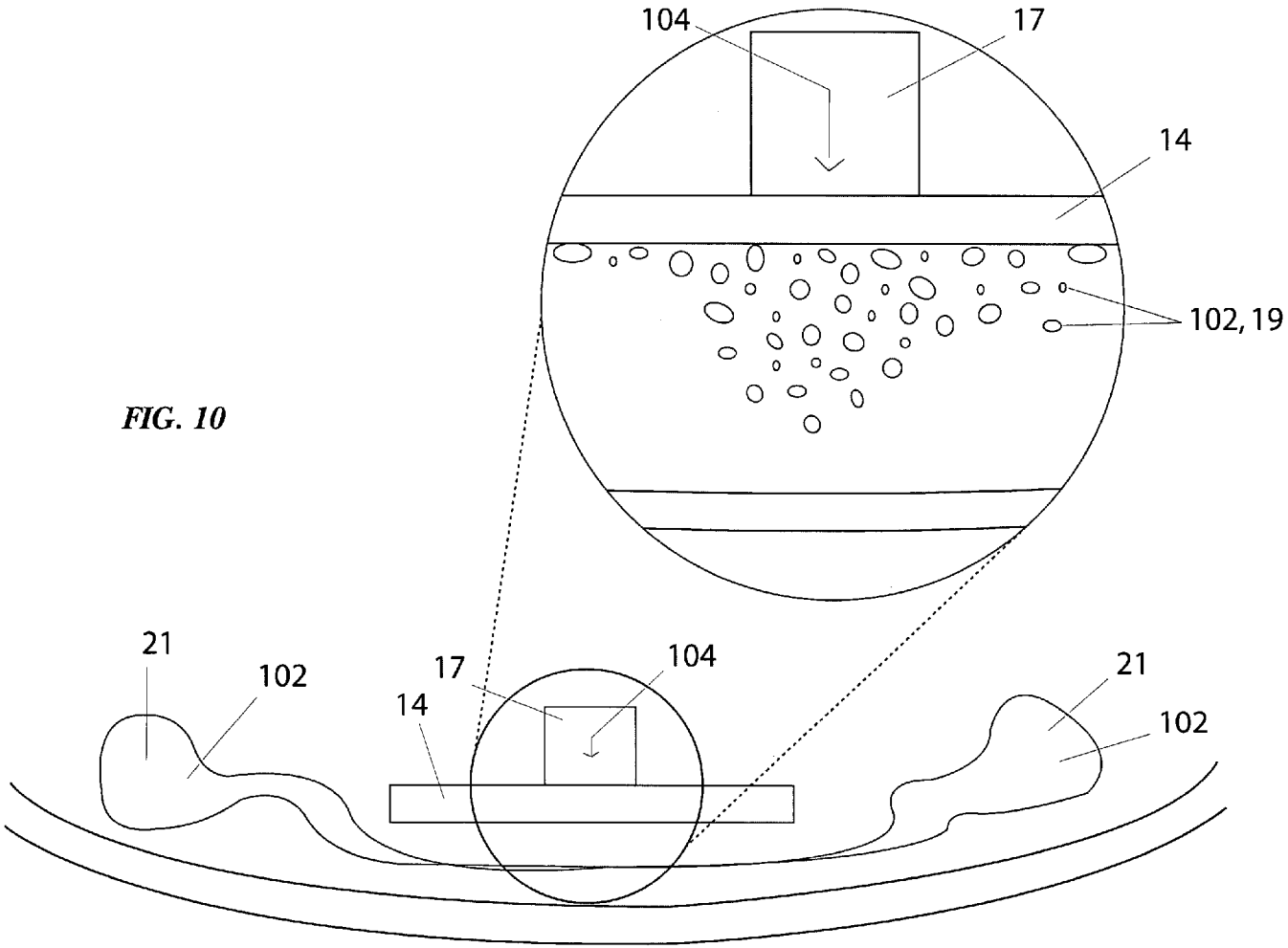
FIG. 10 is a fragmentary enlarged depiction of the bottom portions of the slurry containment/mixing assembly otherwise depicted in FIGS. 5 and 7 with a further enlarged sectional diagrammatic depiction of the accumulator plate shaping an initial matter-moving bubble from gas outlet into the slurry.
Figure 11:
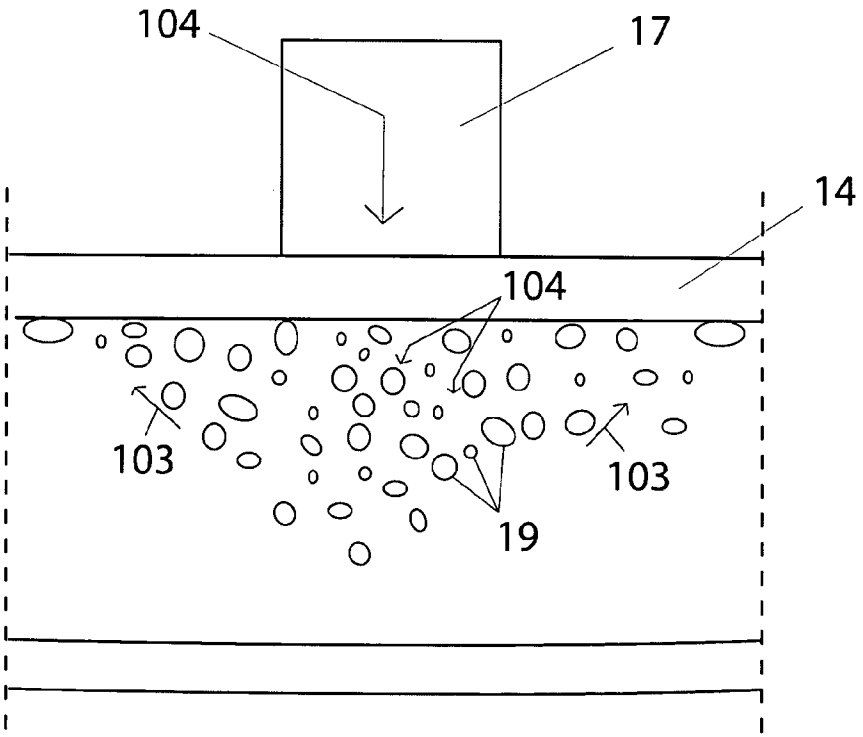
FIG. 11 is a fragmentary enlarged depiction of the accumulator plate otherwise enlarged and shown in FIG. 10 shaping an initial matter-moving bubble from gas outlet into the slurry.

As may be seen from a comparative inspection of FIGS. 10 and 11, airflow (as at vector 104) travels through the gas outlet 17 and enters the slurry mixture in inferior adjacency to the accumulator plate(s) 14. The outlet air as referenced at 102 has a density lesser in magnitude than the density of the slurry mixture, and thus, upon exiting the gas outlet(s) 17 rises as at vector arrow 103 in FIG. 11. Further, the slurry medium into which the gas emerges is viscous and outlet bubbles 19 form as further depicted and referenced in FIGS. 10, and 11. Central to the practice of the present invention are the accumulator plate(s) 14, which plates essentially function to collect and reshape the outletting bubbles 19 into an initially and relatively large, substantially flat bubble or bubbles 20 as generally depicted and referenced in FIGS. 5 and 7. The bubble reshaping process is diagrammatically depicted in FIGS. 10 and 11. Smaller outlet bubbles 19 collect in inferior adjacency to the accumulator plate(s) 14 and form larger reshaping bubbles as at 21 in FIGS. 10 and 11. Once the bubbles emerge from underneath the accumulator plate(s) 14, they form initial and relative large substantially flat bubbles 20 as aided, in part, by the high viscosity of the slurry mixture. The initially and relatively large flat bubbles 20 thus provide or effect a (slurry) component-elevating platform in superior adjacency to the accumulator plate(s) 14 for enhancing upward displacement of gravitationally separable components such as the heavy particulate 101 as well as liquid and light particulate portions of the viscous slurry. The leading surfaces of the bubble(s) 20 thus function to elevate matter from the inferior tank portion 12 to or toward the superior tank portion 11. In other words, it is contemplated that the bubble-reshaping means of the present invention as defined by the accumulator plate(s) 14 may well function to impart maximum bubble lift.

The air-pulsed bubble 20 (or PULSAIR bubble) is relatively round, flat and large. It is formed by a powerful pulse of air (or gas) from under a round, flat plate or accumulator plate 14, which plate 14 is preferably fastened or positioned about one-quarter inch above the bottom of the tank assembly 10. As air bubbles are released, the bubble envelopes force heavier bottom particulate away from the center of the plate. The air quickly reforms into a round bubble above the plate 14, while the bottom particles rush back and are caught up in the trailing surface suction created by the fast rising bubble 20. As the dynamically altered bubble reaches the surface, it pushes product ahead of it, creating a vertical motion which forces contents to the sides and eventually back down the perimeter toward the bottom of the tank assembly 10. With the vertical circular mixing motion established, the contents of the tank assembly 10 may be quickly blended into a uniform mix and can be held in suspension with sequentially timed pulses that require very little expense of energy.

Notably, bubbles form, and coalesce into globular shapes, because those shapes reduce energy. As the bubbles 20 progress to or toward the superior tank portion 11, they undergo dynamic reshaping via interactions with the slurry mixture in order to minimize energy. It is contemplated, however, that the slurry mixture will provide downwardly directed resistance to the upward mobility of the bubbles 20 and maintain the bubbles 20 in a substantially non-spherical shape having a relatively flattened profile for enhancing the (slurry) component-elevating feature of the present invention. The accumulator plate(s) 14 function to impart an initial component-elevating bubble shape, which initial bubble shape will by dynamically altered as it progresses toward the superior tank portion 11. It is contemplated that a flat round accumulator plate or series of longitudinally spaced plates 14 may well function to provide the preferred initial component-elevating platform-like bubble shape as at 20 in FIGS. 5 and 7.

The component-elevating bubble-action of the bubbles 20 thus support the slurry mixing method of the present invention, which method may be said to comprise a number of steps, including initially containing a slurry in a vertically dimensioned structure such as a cylindrical tank or tank assembly 10. It will be recalled that the targeted slurry of the present invention will necessarily comprise a liquid medium as generically depicted and referenced at 105 in FIGS. 5-8, a (relatively) light particulate as at 100 in FIGS. 6-9; a (relatively) heavy particulate as at 101 in FIGS. 6-9; an inherent slurry viscosity, a minimal slurry density, and a slurry-air surface as at 106 in FIGS. 5-9. The particulate(s) 100 and 101 are insoluble in the liquid medium and thus define the slurry mixture.

The tank assembly 10 is preferably cylindrical. In this regard, it is contemplated that a cylindrical tank assembly (1) provides a vertically circular transverse cross section for enhancing cyclic return of materials from the upper portions of the slurry mixture to the lower portions of the slurry mixture (as at vector arrows 107 in FIGS. 5, 7, 8, and 9), and (2) enables maximized bulk tractor-pulled transport of the slurry. In other words, it is contemplated that the container or tank assembly 10 of the present invention may preferably comprise a longitudinal axis for increasing the volume of single batch slurry mixing or for maximizing bulk mixing activity in a single batch. The longitudinally spaced accumulator plates 14 may well function to enhance uniformity of the slurry given the relatively increased volume of a cylindrical configuration over that of spherical configuration with the same diameter.

With further regard to the circular cross section, the reader is directed to FIGS. 3 and 5-10. From a comparative inspection of the noted figures, it may be readily understood that ascending bubble(s) 20 (as at 108) force matter (such as the liquid medium 109, the light particulate 100, and the heavy particulate 101) upwardly and laterally as at vector arrows 110 in FIG. 8. In other words, the slurry components are radially displaced toward the semi-circular pathways defined by the inner container wall 111 as the gaseous media exit the slurry mixture at the slurry-air surface or interface 106 (it being noted that the slurry mixture does not typically completely fill a containment vessel). It is contemplated that the liquid medium 109, light particulate 100, and heavy particulate 101 of the slurry thereafter follow the path or flow pattern generally depicted in FIGS. 5 and 7. The circular cross-section of the tank assembly 10 or slurry containment/mixing assembly of the present invention is thought to provide a smoother pathway so as to otherwise prevent the accumulation of slurry matter in pocketed areas. In other words, a circularly profiled tank reduces pocketed areas where slurry matter may otherwise accumulate.

Figure 9:
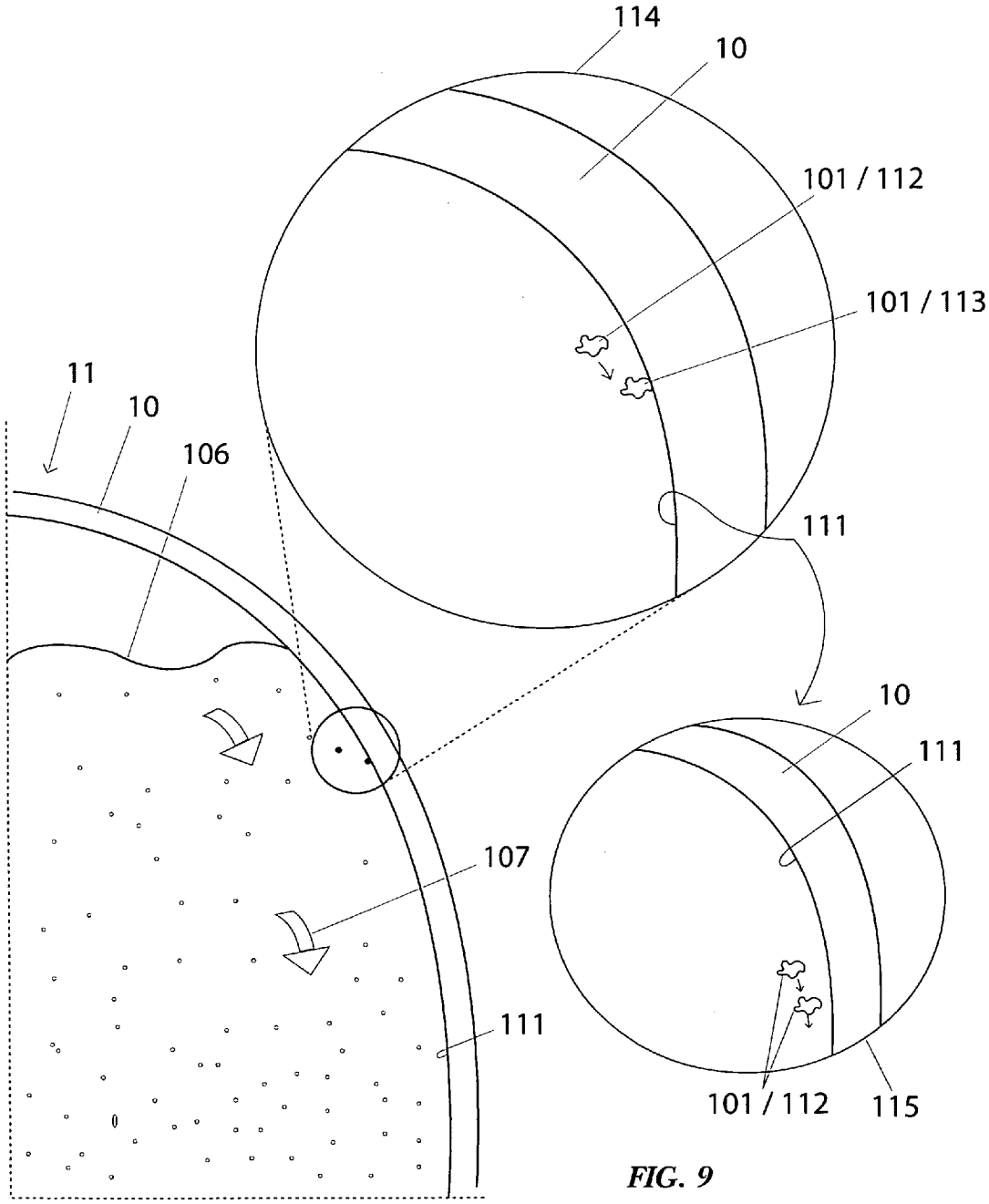
FIG. 9 is a fragmentary enlarged depiction of the upper right portions of the slurry containment/mixing assembly otherwise depicted in FIG. 7 with further enlarged sectional diagrammatic successive depictions of moving particulate wiping the inner wall surface of the slurry containment/mixing assembly.

Further, in keeping with the foregoing notions, it is contemplated that the slurry itself, acting in concert with the opposing semi-circular return pathways or walls of the vertically circular tank structure may well act to wipe the inner wall surface as at 111 and generally depicted in FIG. 9. It may be seen from a consideration of FIG. 9 that flowing matter such as heavy particulate 101/112 may collide with stationary, deposited heavy particulate 101/113, thereby causing the otherwise stationary, deposited heavy particulate 101/113 to become flowing heavy particulate 101/112 as comparatively depicted in the before sectional depiction 114 versus the after sectional depiction 115.

The step of continuously bubbling the gaseous medium into the contained slurry may thus be said to cyclically return the upwardly displaced slurry components to the bottom of the vertically dimensioned structure and in so doing agitates slurry components (such as deposited heavy particulate 101/113) within the vertically-dimensioned structure. It is contemplated that the action of agitating slurry components effectively provides certain container wiping means for preventing accumulation of slurry deposits on slurry-container interfacing. It is thus contemplated that the container wiping means may well function to maintain the slurry container and further enhance uniformity of the slurry mixture. In other words, the container wiping means function to wipe the inner wall 111 of the vertically dimensioned slurry containment vessel and maintain a deposit free inner container wall 111. The process of wiping the inner container wall 111 places into the mixture otherwise deposited matter (such as heavy particulate 101/113) and thus may be said to further enhance the uniformity of the slurry mixture. In other words, by keeping the inner container wall 111 free of deposits, the uniformity of the slurry mixture may by enhanced by keeping target slurry component concentrations at a relatively fixed level.

The invention may be said to essentially teach or disclose a slurry mixing system, comprising slurry, a slurry tank assembly, and certain gas delivery means. The slurry may well be defined by a coal tar or asphalt type sealer and essentially comprises liquid medium as at 109, a relatively light particulate as at 100, a relatively heavy particulate as at 101, a certain slurry viscosity, a minimal slurry density, and a slurry-air surface or interface as at 106. The particulate (s) are insoluble in the liquid medium 109, but the light particulate is suspendable therein while the heavy particulate is gravitationally separable in the liquid medium 109 or separates from the liquid medium 109 via gravitational force.

The tank assembly 10 comprises a superior tank portion as at 11, an inferior tank portion as at 12, a tank diameter as at 13 and at least one accumulator plate 14 or similar other bubble-shaping implement. The tank diameter 13, when vertically conceived, extends intermediate the superior and inferior tank portions 11 and 12. The accumulator plate is preferably cooperably associated with the tank assembly 10 in superior adjacency to the inferior tank portion 12 orthogonal to the vertical tank diameter 13. The heavier particulate, being gravitationally separable, is accumulative adjacent the accumulator plate(s) 14 or adjacent the inferior tank portion 12. Peripheral tank assembly components may include a materials pump 30 as illustrated and referenced in FIGS. 1-3; a hose reel 31 as illustrated and referenced in FIGS. 1-3; and lift hooks 32 as illustrated and referenced in FIGS. 1 and 2 for repositioning the equipment (for example, onto the bed of a transport vehicle).

The gas delivery means may well comprise a gas source, gas conduit, and a gas outlet 17 adjacent the accumulator plate(s) 14. The gas source or inlet such as preferably defined by an air compressor 15 should be capable of delivering 60 psi of air pressure to the mixture. Excellent results (i.e. obtaining properly mixed homogenous sealer slurries) have been obtained with a preferred air pressure of about 60 psi. Although an air pressure of 60 psi is the preferred practice, an air pressure of 30 psi will operate to provide a substantially uniform or homogenous mixture, albeit after a longer period of mixing or slurry agitation. An air pressure of less than 30 psi is thought to be insufficient to properly mix the material within reasonable time limits.

The gas conduit my preferably comprise an air pulse regulator assembly as at 18. The air pulse regulator assembly 18 may preferably comprise a pulse control box assembly 22, an air regulator 23, a water separator 24, inlet conduit 25 (from the compressor 15), and outlet conduit 26 (to the accumulator plate(s) 14) as generally depicted and referenced in FIG. 4. The air pulse regulator assembly 18 functions to periodically and/or continuously bubble the gaseous medium into the contained slurry for selectively altering the dynamics of the accumulator plate-shaped and slurry-shaped gaseous medium. It is contemplated that the periodically outlet gas is akin to formation of a bubble-like waveform, the bubble(s) 20 forming periodic or repetitive substantially similar bubbles over time. Notably, one hallmark of a waveform or wave is its periodicity. The bubble(s) 20 in the resulting bubble train may thus be said to comprise a certain period or frequency settable by the regulator assembly 18, which is contemplated to enable the user to predict when a substantially homogenous uniform slurry is achieved. In other words, it is contemplated that the bubble train or bubble waveform may well function to effect a predictably uniform slurry.

The gaseous medium may be continuously bubbled into the contained slurry with periodicity occurring via accumulator plate action (i.e. the collection and reshaping of outlet gas). The primary function of a continuously bubbled gaseous medium is to cyclically return upwardly displaced slurry components to the bottom of the vertically dimensioned structure. In other words, if the bubble action is terminated before a cyclic flow pattern may be established, the benefits of wall wiping and uniform mixing may not be realized. It is contemplated that when the gaseous medium is continuously bubbled into the contained slurry, the continuously bubbled gaseous medium thereby functions to cycle the displaced slurry components, and together the cycled and displaced slurry components enhance uniformity of the slurry.

As stated, the gas outlet 17 is cooperable with the accumulator plate(s) 14. The accumulator plates are preferably longitudinally and equally spaced in a cylindrical tank to enhance uniformity of the slurry mixture. The gas outlet 17 essentially functions to outlet gas or air into the tank via the gas source and the gas conduit. The accumulator plate(s) 14 essentially function to plate-shape the outlet gas into an initially planar bubble shape as at 20 in FIGS. 5 and 7. The initially planar bubble shape 20 is upwardly directed toward the superior tank portion 11 (by being less dense that the minimal slurry density) in radial adjacency to the tank diameter 13 as further depicted in FIG. 5. The slurry viscosity dynamically reshapes the upwardly directed planar bubble shape 20 as at bubble shapes 40 in FIGS. 5 and 7. The outlet gas dynamically and vertically displaces heavy particulate 101 (as well as liquid media 109 (bearing light particulate 100)) toward the superior tank portion 11 via dynamic matter-displacing bubble action. The initially planar bubble shape 20 is contemplated to maximize the effectiveness of the bubble action for mixing the slurry. When the gas is periodically inlet at the longitudinally spaced locations, the periodically inlet gas is thought to form a bubble train or a bubble waveform. The bubble train or trains function to effect bubble action particulate displacements for maintaining a uniform slurry mixture.

While the above descriptions contain much specificity, this specificity should not be construed as limitations on the scope of the invention, but rather as an exemplification of the invention. For example, it is contemplated that the present invention essentially teaches a slurry mixing apparatus for mixing slurry components, which apparatus comprises a slurry container, certain gas delivery means, and certain bubble-reshaping means. The slurry container essentially functions to contain a viscous slurry and it comprises superior and inferior container portions. The gas delivery means essentially function to deliver and outlet a gaseous medium into the slurry container via the inferior container portion. The bubble-reshaping means may be defined by a bubble-reshaping implement such as the accumulator plate (s) and essentially function to reshape the gaseous medium that is outlet into the viscous slurry into a substantially planar (initial) macro-bubble. The substantially planar initial bubble effects a component-elevating platform for imparting maximum bubble lift or for enhancing upward displacement of gravitationally separable components of the viscous slurry.

It is further contemplated that the foregoing teachings inherently support certain mixing methods. For example, it is contemplated that one method supported by the foregoing descriptions may preferably comprise the steps of containing a slurry in a cylindrical tank having an inferior tank portion and inletting gas at longitudinally spaced positions along the inferior tank portion (which inlet gas has a gaseous density lesser in magnitude than the minimal slurry density thus forming a gas-slurry density difference); plate-shaping the inlet gas into longitudinally spaced bubbles by way of the gas-slurry density difference and the slurry viscosity. Notably, the longitudinally spaced bubbles each have a leading bubble surface and a trailing bubble surface.

The bubbles are thus vertically directed toward the superior tank portion in radial adjacency to the vertical tank diameter by way of the gas-slurry density difference and under dynamic action of the slurry viscosity impingent on the ascending bubbles. In other words, the slurry's measured resistance to flow operates to dynamically slurry-shape the bubbles, which slurry-shaped bubbles dynamically and vertically displace slurry components (most notably the heavy particulate) toward the superior tank portion.

The action of breaking the bubbles at the slurry surface or slurry-air interface operates to laterally displace slurry components toward the inner tank wall and completes a bubble action particulate displacement, after which the slurry components cyclically return to the inferior tank portion via the inner tank wall. The bubble action particulate displacement and the vertically and laterally displaced slurry matter thus yields a substantially uniform, homogenous slurry mixture in due course. Given an air pressure of 60 psi, the uniformity of the slurry mixture may be achieved relatively rapidly.

Figure 12:
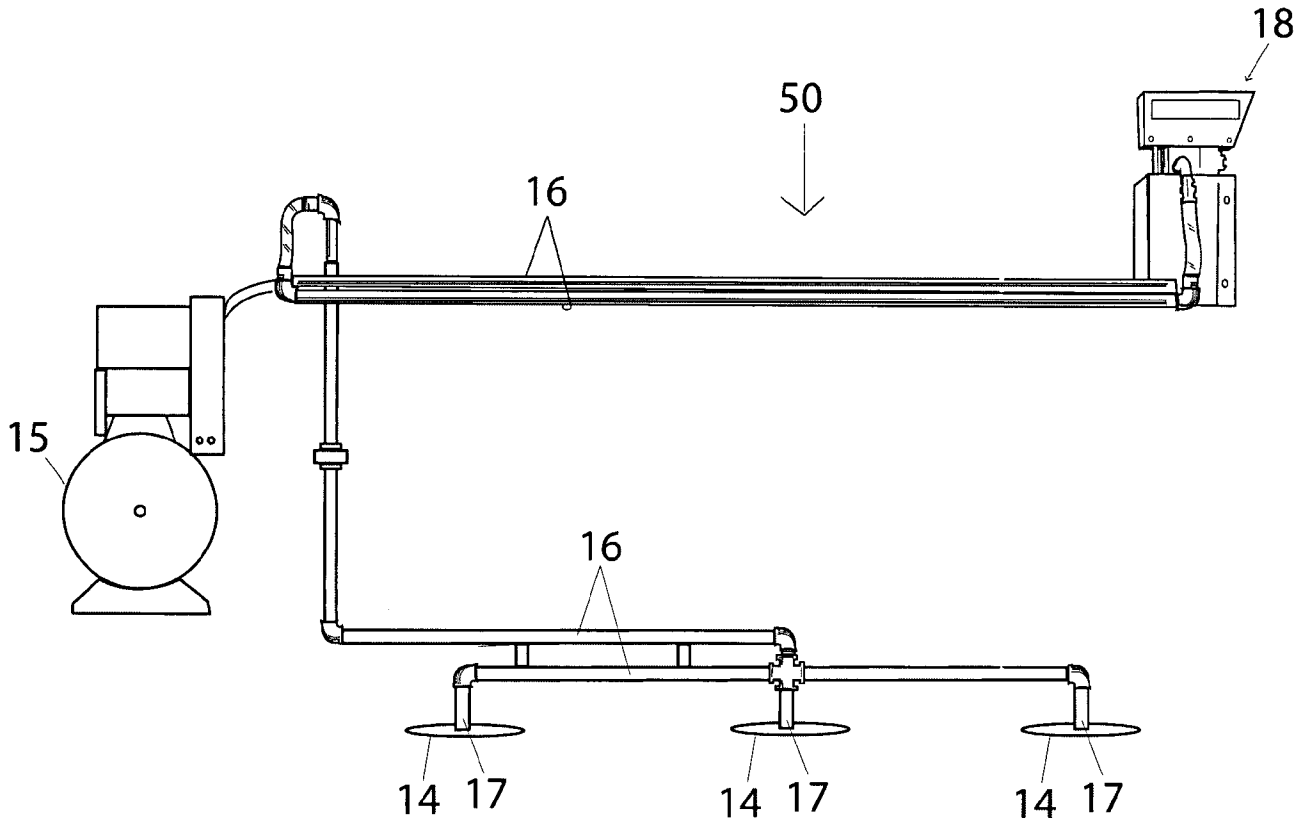
FIG. 12 is a fragmentary first side plan view of an gas-delivery kit of the present invention showing an gas source, gas delivery conduit, and bubble-shaping implements.
Figure 13:
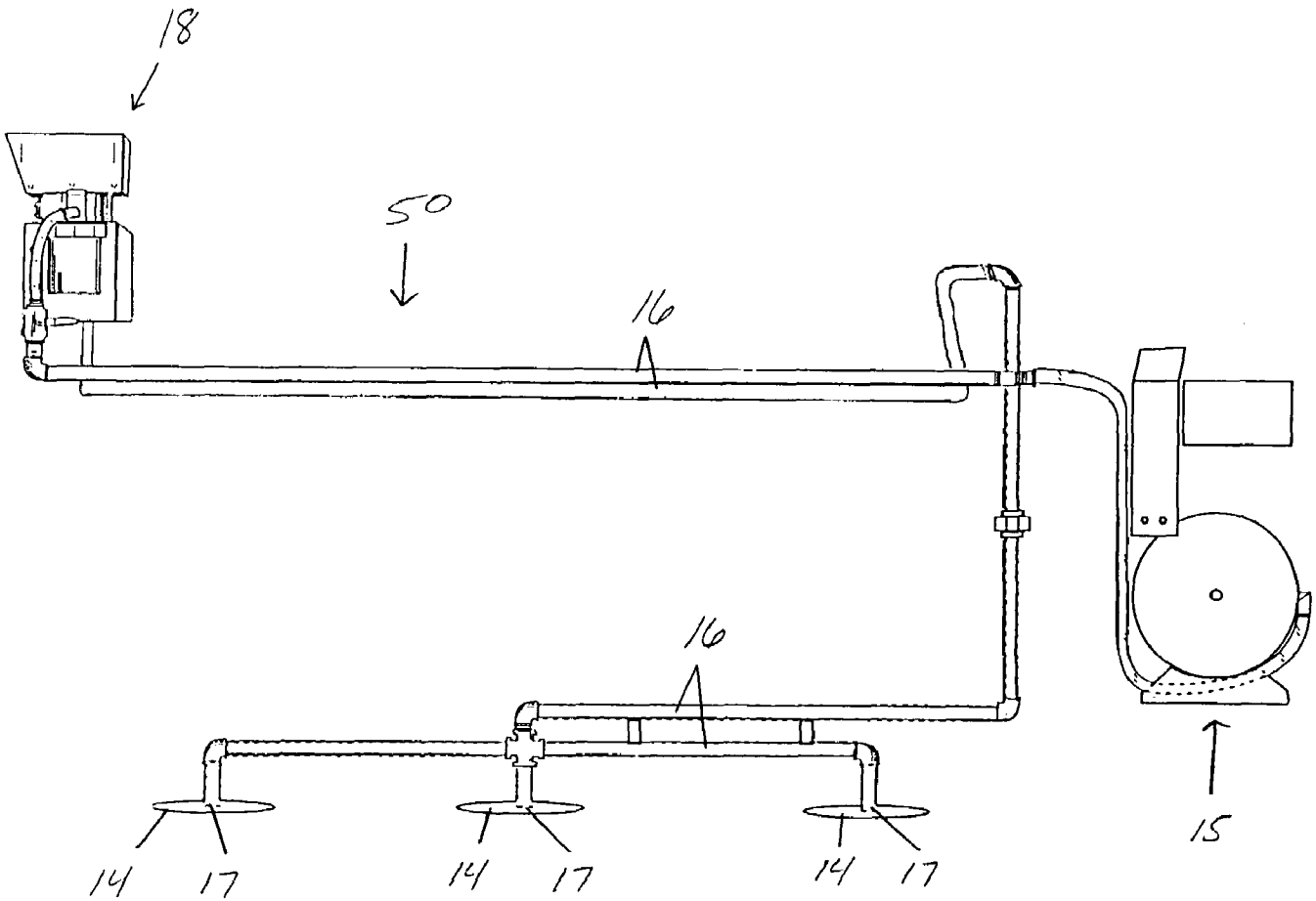
FIG. 13 is a fragmentary second side plan view of an gas-delivery kit of the present invention showing an gas source, gas delivery conduit, and bubble-shaping implements.

Further, it is contemplated that tank assemblies and the like may be retrofittable with certain kit-provided elements of the present invention so as to outfit slurry mixing tank assemblies with the kit and thus make slurry mixing more effective. In this regard, it is further contemplated that the present may be said to further support a gas or air-delivery kit 50 as generally depicted and referenced in FIGS. 12 and 13. It may be seen from a comparative inspection of FIGS. 1 and 2 versus FIGS. 12 and 13 that the gas or air-delivery kit 50 of the present invention may be said to exhaustively comprises the gas source or inlet as preferably defined by an air compressor assembly 15; gas delivery conduit as at 16 (further comprising one or more gas outlets 17); and the bubble-reshaping means as preferably definable by the accumulator plates 14.

It is further contemplated, however, that the essence or heart of the present invention is centered at the accumulator plate or bubble shaping feature. Thus, it is contemplated that the kit of the present invention necessarily includes bubble-reshaping or bubble shaping means as preferably definable by the accumulator plates 14. A gas-delivery kit contemplated or supported by the foregoing is designed to outfit a slurry-mixing container assembly and essentially comprises bubble-shaping means. The bubble-shaping means are outfittable with certain gas conduit for implement-shaping outlet gas (as directed to the bubble-shaping means via the gas conduit) into an initial bubble action shape as at 20. As earlier specified, the initial bubble action shape 20 essentially functions to maximize the slurry-displacing effectiveness of resultant ascending bubble action. The kit may well comprise gas conduit as a means to enhance the action of the bubble-shaping means and for aiding installation thereof on a slurry-mixing container assembly. The gas conduit essentially functions to direct gas from a gas source to the bubble-shaping means and to outlet gas adjacent the bubble-shaping means within a slurry-containing container assembly.

Although the invention has been described by reference to a preferred embodiment and inherent methodology supported by the apparatus, it is not intended that the novel apparatus or methodology be limited thereby, but that modifications thereof are intended to be included as falling within the broad scope and spirit of the foregoing disclosure and the appended drawings.

I claim:

1. A slurry mixing method, the slurry mixing method for mixing slurry components, the slurry mixing method comprising the steps of:

containing a slurry in a vertically circular container, the vertically circular container having inferior and superior container portions, a vertical diameter, and circular inner container wall;

inletting gas at the inferior container portion into the contained slurry, the inlet gas being upwardly directed;

plate-shaping the upwardly directed inlet gas into an initial component-displacing bubble;

vertically directing the initial component-displacing bubble toward the superior tank portion along the vertical diameter;

slurry-shaping the initial component-displacing bubble, the slurry-shaped bubble for displacing slurry components toward the superior tank portion; and breaking the slurry-shaped bubble at a slurry surface for radially displacing the slurry components relative to the vertical diameter and completing a single bubble action component displacement.

2. The slurry mixing method of claim 1 wherein the gas is periodically inlet at the inferior container portion, the periodically inlet gas for forming a bubble train, the bubble train for effecting plural bubble action component displacements along the vertical diameter the diametrically directed component displacements for enhancing uniformity of the contained slurry.

3. The slurry mixing method of claim 2 wherein the gas is continually inlet at the inferior container portion, the continuously inlet gas for cycling slurry components via the diametrically directed bubble train and the circular inner container wall.

4. The slurry mixing method of claim 3 wherein the step of cycling slurry components via the circular inner container wall agitates slurry components adjacent the circular inner container wall, said slurry component agitation for wiping the circular inner container wall and for enhancing uniformity of the contained slurry.

5. A slurry mixing method the slurry mixing method for maintaining a substantially uniform slurry mixture, the slurry mixing method comprising the steps of:

containing a slurry within a vertically circular structure, the slurry having gravitationally separable slurry components;

bubbling a gaseous medium into the contained slurry adjacent the bottom of the vertically circular structure;

implement-shaping the bubbled gaseous medium with a gas shaping implement;

vertically directing the implement-shaped gaseous medium toward the top of the vertically circular structure along a vertical diameter thereof;

simultanteously displacing the slurry components and slurry-shaping the implement-shaped gaseous medium, the displaced slurry components tending the slurry toward a substantially uniform slurry.

6. The slurry mixing method of claim 5 wherein the gaseous medium is periodically bubbled into the contained slurry, the periodically bubbled gaseous medium for forming a bubble waveform along the vertical diameter, the bubble waveform for effecting a predictably uniform slurry.

7. The slurry mixing method of claim 6 wherein the gaseous medium is continuously bubbled into the contained slurry, the continuously bubbled gaseous medium for cycling the displaced slurry components via the vertical diameter and vertical circular structure, the cycled and displaced slurry components for enhancing uniformity of the slurry.

8. The slurry mixing method of claim 5 wherein the gaseous medium is periodically and continuously bubbled into the contained slurry, the periodically and continuously bubbled gaseous medium for cycling the displaced slurry components via the vertical diameter and vertical circular structure and for effecting an enhanced and predictably uniform slurry.

9. The slurry mixing method of claim 5 wherein the slurry components are displaced and the gaseous medium is slurry-shaped in radial adjacency to the vertical diameter of the vertically circular structure.

10. The slurry mixing method of claim 9 wherein the slurry components are cyclically returned to the bottom of the vertically circular structure via opposing semi-circular return pathways of the vertically circular structure, the semi-circular return pathways for enhancing uniformity of the slurry mixture.

11. The slurry mixing method of claim 10 wherein the slurry components are radially displaced toward the semi-circular pathways as the gaseous media exit the slurry.

12. The slurry mixing method of claim 10 wherein the step of continuously bubbling the gaseous medium into the contained slurry agitates slurry components within the vertically circular structure, said slurry component agitation for wiping the return pathways of the vertically circular structure and for enhancing uniformity of the slurry.

* * * * *